US006139012A

United States Patent [19]

Furuya et al.

[11] Patent Number: 6,139,012

[45] Date of Patent: Oct. 31, 2000

[54] IMAGE FORMING UNIT SYSTEM

[75] Inventors: Nobuyuki Furuya; Yoshihiko Sano; Sadanori Kobashi; Yoshinori Kawaai, all of Ibaraki, Japan

[73] Assignee: Hitachi Koki Co., Ltd., Tokyo, Japan

[21] Appl. No.: 09/310,991

[22] Filed: May 13, 1999

[30] Foreign Application Priority Data

Aug. 20, 1998 [JP] Japan ..... 10-234706

[51] Int. Cl.[7] ..... B65H 29/20

[52] U.S. Cl. ..... 271/314

[56] References Cited

U.S. PATENT DOCUMENTS

| | | | |
|---|---|---|---|
| 4,974,828 | 12/1990 | Matsuo et al. | 271/293 X |
| 5,086,320 | 2/1992 | Koike | 355/318 X |
| 5,602,571 | 2/1997 | Suda et al. | 346/134 X |
| 5,742,318 | 4/1998 | Miyauchi et al. | 347/134 X |
| 5,879,002 | 3/1999 | Nakumura et al. | 371/10.11 X |
| 6,042,111 | 3/2000 | Rivers et al. | 271/270 |
| 6,062,556 | 5/2000 | McCay | 271/9.13 X |

FOREIGN PATENT DOCUMENTS

| | | | |
|---|---|---|---|
| 403098946 | 4/1991 | Japan | 271/270 |

*Primary Examiner*—Christopher P. Ellis
*Assistant Examiner*—Ken Bower
*Attorney, Agent, or Firm*—Sughrue, Mion, Zinn, Macpeak & Seas, PLLC

[57] ABSTRACT

In an image forming unit system, a sheet handling unit having a fixed sheet carrying-in rate is connected to an image forming unit having a sheet ejection rate controlled variably so that stable sheet carrying can be achieved. The sheet carrying rate (VF) of a sheet carrying-in roller pair (26) provided in a sheet handling unit (2) is defined to be higher than the sheet carrying rate (VU and VD) of a sheet ejection roller pair (16) provided in an image forming unit (1). The pressing force (F2) between the rollers of the sheet carrying-in roller pair is defined to be smaller than the pressing force (F1) between the rollers of the sheet ejection roller pair.

3 Claims, 2 Drawing Sheets

IMAGE FORMING UNIT SYSTEM

BACKGROUND OF THE INVENTION

1. Field of the Invention

The present invention relates to an image forming unit system having a sheet handling unit connected to a post-stage of an image forming unit represented by a printer, a copying machine, or the like.

2. Description of the Related Art

An image forming unit system has been put into practical use. In such an image unit system, a sheet handling unit represented by a stacker provided with a sheet tray, a finisher provided with an post-processing unit such as a stapler, or the like, is connected to a post-stage of an image forming unit represented by a printer, a copying machine, etc. so that the sheet handling property, working efficiency, etc. after printing are improved. In the background art, such an image forming unit system had a configuration in which when the system was operated, the image forming unit and the sheet handling unit were connected to each other through an interface signal line, or the like, so as to be able to communicate each other so that the sheet carrying-in rate of the sheet handling unit was controlled in accordance with the sheet ejection rate of the image forming unit while the two units were communicating each other.

Accordingly, in the case of such a technique in the background art, there was a defect that not only the controlling of the sheet handling unit was complex but also the cost of the system was high.

SUMMARY OF THE INVENTION

An object of the present invention is to eliminate the aforementioned defect by providing an image forming unit system in which a sheet handling unit having a fixed sheet carrying-in rate is connected to an image forming unit having a sheet ejection rate controlled variably so that stable sheet carrying can be achieved.

The foregoing object is achieved by an image forming unit system in which a sheet handling unit is connected to a post stage of an image forming unit, characterized in that a sheet carrying rate of a sheet carrying-in roller pair provided in the sheet handling unit is defined to be higher than a sheet carrying rate of a sheet ejection roller pair provided in the image forming unit, and a pressing force of the sheet carrying-in roller pair is defined to be smaller than a pressing force of the sheet ejection roller pair.

DETAILED DESCRIPTION OF THE PREFERRED EMBODIMENTS

Figure 2:
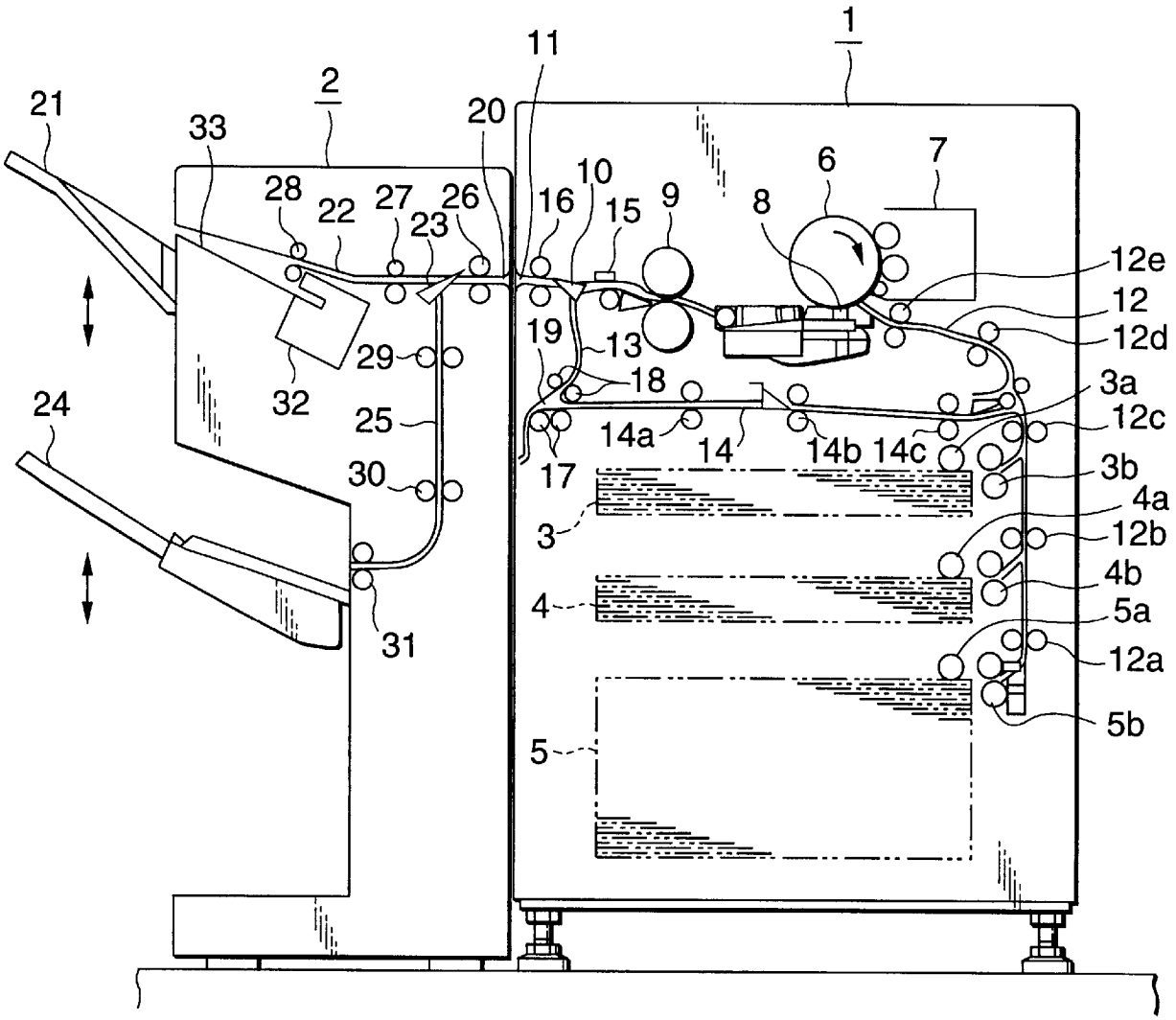
FIG. 2 is an overall configuration view of the image forming unit system according to the present invention.

An embodiment of the present invention will be described below with reference to the drawings. As shown in FIG. 2, an image forming unit system is constituted by an image forming unit 1, and a sheet handling unit 2. In this embodiment, a laser printer in which a photosensitive material is used to record and form a toner image on a sheet material through a known electrophotographic process is illustrated as an example of the image forming unit. Further, a finisher which can perform stapling to the sheets ejected from the printer 1 is illustrated as an example of the sheet handling unit 2.

In the printer 1, the reference numerals 3, 4 and 5 designate sheet stocking portions for stocking sheets of paper as the sheet material. The reference numeral 6 designates a photoconductor drum which begins to rotate in the direction of the arrow on the basis of a signal from a controller (not shown). When the photoconductor drum 6 begins to rotate, the surface of the photoconductor drum 6 is charged electrically evenly by a corona electrifier (not shown). An electrostatic latent image is formed on the electrically-charged photoconductor drum 6 by a laser beam emitted from an exposure unit (not shown). When the electrostatic latent image reaches the position of a developing unit 7, the electrostatic latent image is developed by toner so that a toner image which is visible is formed on the photoconductor drum 6. The toner image formed thus through a known electrophotographic process is transferred by a transfer device 8 onto a sheet of paper fed from the sheet stocking portion 3, 4 or 5 or from a return path 14 which will be described later. The reference numeral 9 designates a fixing unit. In this embodiment, the fixing unit is constituted by a heat roller and a pressure roller which are in pressure contact with each other. The fixing unit fixes the toner image transferred onto the sheet of paper. The reference numeral 10 designates a gate which has a function for switching the direction of the sheet of paper which is being carried.

Incidentally, with respect to sheet carrying paths provided in the printer 1, a sheet carrying path 12 for connecting the sheet stocking portions 3, 4 and 5, the image forming means 6, 7 and 8 and a sheet ejection port 11 of the printer 1 will be referred to as "a sheet feed path" for convenience' sake in the following description. Further, a path 13 will be referred to as "a leading-in path". The path 13 is provided so as to diverge from the sheet feed path 12 on the downstream side in the sheet carrying direction with respect to the image forming means 6, 7 and 8, so that a sheet of paper fed from the fixing unit 9 is led in selectively on the basis of the switching control of the gate 10. Further, a path 14 will be referred to as "a return path". The path 14 is provided so as to diverge from an intermediate portion of the leading-in path 13 and the terminal of the path 14 is joined to the sheet feed path 12 on the upstream side in the sheet carrying direction with respect to the image forming means 6, 7 and 8.

Incidentally, in FIG. 2, the reference numeral 15 designates a carrying roller pair provided in a pre-stage of the gate 10; 16, an ejection roller pair provided in a post-stage of the gate 10; 17 and 18, carrying roller pairs provided on the leading-in path 13 so as to be able to rotate reversibly by switching; and 19, a gate for performing switching as to whether a sheet of paper led in the leading-in path 13 is to be fed to the return path 14 or to be returned to the sheet feed path 12 so as to be ejected from the ejection port 11 of the printer 1.

With the aforementioned configuration, when a sheet of paper having a single side printed is to be ejected from the printer 1 in the condition that the printed surface of the sheet of paper faces up (hereinafter referred to as "face-up ejection mode"), the sheet of paper fed from the fixing unit 9 is ejected as it is from the ejection port 11 along the sheet feed path 12 so as to be sent out to the finisher 2.

On the other hand, when a sheet of paper having a single side printed is to be ejected from the printer 1 in the condition that the printed surface of the sheet of paper faces down (hereinafter referred to as "face-down ejection mode"), the sheet of paper fed from the fixing unit 9 is guided by the carrying roller pair 15 and the gate 10 so as to be led in the leading-in path 13. At the timing when the rear end of the sheet of paper reaches a predetermined position in the leading-in path 13, the carrying roller pair 18 are rotated in a direction reverse to the direction at the time of leading-in so that the sheet of paper is carried to the ejection roller pair 16 so as to be ejected from the ejection port 11 to be sent out to the finisher 2.

In the case where printing is to be performed on double sides of a sheet of paper, the sheet of paper fed from the fixing unit 9 is led in the leading-in path 13 and sent out to the return path 14 so that the sheet of paper having a single side printed is fed to the image forming means 6, 7 and 8 again to thereby perform double-side printing.

Incidentally, in FIG. 2, the reference numerals 3*a*, 4*a* and 5*a* designate pick rollers for sending out sheets of paper stocked in the sheet stocking portions 3, 4 and 5 respectively, and 3*b*, 4*b* and 5*b* designate sheet feed roller pairs. Generally known, each of the sheet feed roller pairs 3*b*, 4*b* and 5*b* is constituted by a feed roller and a retard roller and has a function that sheets of paper sent out through the pick roller 3*a*, 4*a* or 5*a* are fed one by one to the sheet feed path 12 while the sheets of paper carried are prevented from overlapping each other.

The reference numerals 12*a*, 12*b*, 12*c* and 12*d* designate carrying roller pairs through which a sheet of paper in the sheet feed path 12 is carried; and 12*e*, a resist roller pair for carrying a sheet of paper in synchronism with the timing when the toner image formed on the photoconductor drum 6 is transferred onto the sheet of paper. The reference numerals 14*a*, 14*b* and 14*c* designate carrying roller pairs through which a sheet of paper in the return path 14 is carried.

The configuration of the finisher 2 will be described below. The finisher 2 is connected to the printer 1 so that a carrying-in port 20 of the finisher 2 is connected to the ejection port 11 of the printer 1. In the finisher 2, there are provided a sheet feed path 22 for connecting a sheet ejection tray 21 to the carrying-in port 20, a sheet feed path 25 for connecting a sheet ejection tray 24 to a diverging point (near a gate 23) provided on the sheet feed path 22, and a carrying-in roller pair 26 and carrying roller pairs 27, 28, 29, 30 and 31 for carrying sheets of paper along the sheet feed paths 22 and 25 to the sheet ejection trays 21 and 24. Incidentally, the reference numeral 32 designates a stapler for stapling a bundle of sheets of paper ejected to the sheet ejection tray 21.

With the aforementioned configuration, sheets of paper sent out from the ejection port 11 of the printer 1 are introduced to the finisher 2 through the carrying-in port 20. When stapling is required, sheets of paper are carried to the sheet ejection tray 21 and stacked up on a work tray 33. When a predetermined number of sheets of paper have been stocked, the sheets of paper are stapled by means of the stapler 32. The bundle of sheets of paper stapled thus is ejected onto the sheet ejection tray 21 by means of an ejection unit (not shown).

On the other hand, when stapling is not required, sheets of paper are guided to the sheet feed path 25 through the gate 23 and ejected onto the sheet ejection tray 24 through the carrying roller pairs 29, 30 and 31. Here, the gate 23 operates in the direction to carry sheets of paper to the destination of sheet ejection designated by a sheet post-processing method transmitted through a command signal line at a turning point when a sheet ejection signal (which will be described later) is switched from a low level to a high level.

Incidentally, each of the sheet ejection trays 21 and 24 is provided so as to be able to ascend/descend in the directions of the arrows. Each tray is controlled so that the upper surface of the tray has a preset positional relation with each ejection port of the finisher 2 in accordance with the quantity of sheets stocked on the tray.

In the printer 1 of the aforementioned image forming unit system, the pick rollers 3*a*, 4*a* and 5*a*, the sheet feed roller pairs 3*b*, 4*b* and 5*b*, the carrying roller pairs 12*a*, 12*b*, 12*c* and 12*d*, the resist roller pair 12*e*, the fixing roller pairs constituting the fixing unit 9, the carrying roller pair 15, and the carrying roller pairs 14*b* and 14*c* provided in the return path 14 are arranged so that their sheet carrying rate is set to be about 12.37 inches/sec (about 314.2 mm/sec). Incidentally, the sheet carrying rate of the carrying roller pair 15 may be set to be about 12.37 inches/sec+2 % so that the sheet of paper fed from the fixing roller pair is not loosened.

Further, the ejection roller pair 16, the carrying roller pairs 17 and 18, and the carrying roller pairs 14*a* provided in the return path 14 are arranged so that their sheet carrying rate is set so as to be switchable over between a first sheet carrying rate of about 12.37 inches/sec and a second sheet carrying rate of about 22.77 inches/sec (about 578.4 mm/sec).

In the case where a sheet of paper is to be ejected from the printer 1 in the face-up ejection mode, the pick rollers 3*a*, 4*a* and 5*a*, the sheet feed roller pairs 3*b*, 4*b* and 5*b*, the carrying roller pairs 12*a*, 12*b*, 12*c* and 12*d*, the resist roller pair 12*e*, the fixing roller pairs, the carrying roller pair 15 and the ejection roller pair 16 are driven at a sheet carrying rate of about 12.37 inches/sec to perform sheet carrying (hereinafter, the sheet carrying rate of 12.37 inches/sec is referred to also as "VU").

When a sheet of paper is to be ejected from the printer 1 in the face-down ejection mode, the sheet carrying rate of the carrying roller pairs 17 and 18 and the ejection roller pair 16 is switched over from VU to a sheet carrying rate of 22.77 inches/sec at a predetermined timing (hereinafter, the sheet carrying rate of 22.77 inches/sec is referred to as "VD"). For example, the switching-over of the sheet carrying rate from VU to VD is performed at a turning point when the rear end of the sheet of paper has passed through the fixing unit 9. Here, the reason why the sheet carrying rate is switched over between the face-up ejection mode and the face-down ejection mode is as follows. That is, this is because, in the face-down ejection mode, a step is required such that the sheet of paper after passed through the fixing unit 9 is once led in the leading-in path 13 and then returned to the sheet feed path 12. This is also because the throughput of the system is brought close to that in the face-up ejection mode as possible.

On the contrary, in the finisher 2, the sheet carrying rate of the carrying-in roller pair 26 and the carrying roller pairs 27, 28, 29, 30 and 31 is set constant in a range of from about VD+1% to about VD+3% (in this embodiment, the sheet carrying rate is set to about 22.83 inches/sec (about 580 mm/sec). Hereinafter, the sheet carrying rate of 22.83 inches/sec will be referred to as "VF".

Further, the rollers of each of the roller pairs is as follows. The carrying roller pairs 12*a*, 12*b*, 12*c* and 12*d* and the resist roller pair 12*e* come in pressure contact with each other under a pressing force in a range of from about 800 g to about 1000 g (in this embodiment, the pressing force is set to about 800 g). The rollers of the fixing roller pair come in pressure contact with each other under a pressing force of about 50 kg. The rollers of each of the carrying roller pair 15 and the rollers of the ejection roller pair 16 come in pressure contact with each other under a pressing force in a range of from about 400 g to about 1000 g, preferably, 500±100 g. The rollers of each of the carrying roller pairs 17 and 18 come in pressure contact with each other under a pressing force of about 1000 g. The rollers of each of the carrying roller pairs 14*a*, 14*b* and 14*c* come in pressure contact with each other under a pressing force of about 500 g. The rollers of each of the sheet feed roller pairs 3*b*, 4*b* and 5*b* come in pressure contact with each other under a pressing force of about 350 g. Further, each of the pick rollers 3*a*, 4*a* and 5*a* comes in pressure contact with a sheet of paper under a pressing force of about 150 g. On the other hand, the rollers of each of the carrying-in roller pair 26 and the carrying roller pairs 27, 28, 29, 30 and 31 of the finisher 2 come in pressure contact with each other under a pressing force of about 200 g.

The printer 1 and the finisher 2 are connected through an interface signal line so as to be able to communicate each other. The interface signal line includes: a command signal line for transmitting information (selection of a sheet ejection tray, with or without stapling operation, stapling position, etc.) concerning the type of the sheet of paper to be carried from the printer 1, the sheet post-processing method in the finisher 2, etc. by a serial transmission method; a sheet ejection signal line for dealing with a hardware signal in which when the sheet of paper is ejected from the printer 1 to the finisher 2, the voltage level is changed from a low level to a high level to thereby inform the ejection of a sheet of paper.

When printing starts, the aforementioned information concerning the type of the printing sheet of paper and the post-processing method is transmitted to the finisher 2 through the command signal line. When the sheet of paper is ejected to the finisher 2, the level of the sheet ejection signal line changes from a low level to a high level. The finisher 2 starts and executes sheet post-processing designated by the transmitted information concerning the sheet post-processing method at a turning point when the level of the sheet ejection signal is changed from a low level to a high level.

Figure 1:
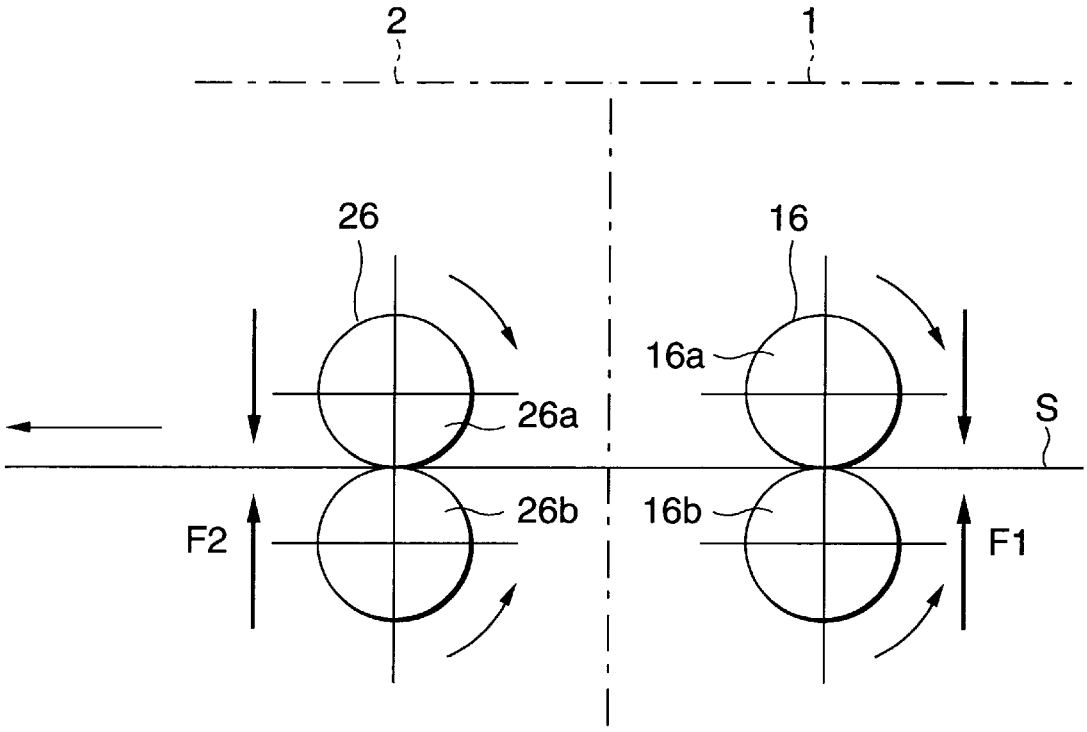
FIG. 1 is an explanatory view showing the condition of sheet delivery in an image forming unit system according to the present invention.

The condition of delivery of a sheet of paper from the printer 1 to the finisher 2 will be described below with reference to FIG. 1. The rollers shown in FIG. 1 are an ejection roller pair 16 of the printer 1 and a carrying-in roller pair 26 of the finisher 2. In FIG. 1, the arrow F1/F2 shows a pressing force between an upper roller (16*a*/26*a*) and a lower roller (16*b*/26*b*) constituting each of the roller pairs. The larger the pressing force is, the larger carrying force becomes consequently. In FIG. 1, assuming now that the pressing force of the ejection roller pair 16 and the pressing force of the carrying-in roller pair 26 are F1 and F2 respectively, F1 and F2 in the present invention are about 500 g and about 200 g respectively and are set to satisfy the relation of F1>F2.

In the above-mentioned manner of setting the roller pairs 16 and 26, when a sheet of paper is carried so as to be laid between the ejection roller pair 16 of the printer 1 and the carrying-in roller pair 26 of the finisher 2, the carrying-in roller pair 26 runs idle so that the sheet of paper cannot be carried substantially before the sheet of paper passes through the ejection roller pair 16. After the sheet of paper passes through the ejection roller pair 16, the sheet of paper is carried at a high rate through the carrying-in roller pair 26.

When relations among sheet carrying rates VU, VD and VF and the pressing forces F1 and F2 with respect to the ejection roller pair 16 of the printer 1 and the carrying-in roller pair 26 and the carrying roller pairs 27, 28, 29, 30 and 31 of the finisher 2 are established as described above, the following effects are obtained.

First, no means for controlling the sheet carrying-in rate of the finisher in accordance with the sheet ejection rate of the printer as in the background art may be required, so that configuration is prevented from being made complex.

Second, the delivery of a sheet of paper from the printer to the finisher can be achieved smoothly without providing any complex control means. That is, in the printer in this embodiment, the sheet picking timing of the pick rollers 3*a*, 4*a* and 5*a* is set to be a period of 850 msec so that printing is performed on the sheet of paper under the condition of the sheet carrying rate of about 12 inches/sec. When, for example, a letter-size (8.5 inches×11 inches) sheet of paper is fed transversely (carried while the side of 11 inches intersects perpendicularly to the sheet carrying direction) in this case, a sheet distance of about 51 mm is formed between the preceding and succeeding sheets of paper. Here, the sheet distance of about 51 mm is insufficient to keep the time enough to complete the switching operation of the gate 23 provided in the finisher 2. This also depends on the specification of a solenoid for operating the gate 23. When, for example, the switching operation of the gate 23 takes about 200 msec, it is necessary to form a sheet distance in a range of from about 60 mm to about 100 mm between the preceding and succeeding sheets of paper in the vicinity of the gate 23.

With respect to this point, according to the present invention, when the preceding and succeeding sheets of paper are carried in the printer 1 in the face-up ejection mode, the sheet distance between the two sheets of paper is about 51 mm. However, in the state where the preceding sheet of paper is ejected from the printer 1 and the front end of the succeeding sheet of paper reaches the ejection roller pair 16 of the printer 1, the sheet distance is widened to about 145 mm. Further, at the point of time when the rear end of the preceding sheet of paper passes through the gate 23 of the finisher 2, carrying is performed so that the sheet distance is widened to about 194 mm. Accordingly, in order to widen the sheet distance, it is not necessary to carry the succeeding sheet of paper at a low rate or stopping the succeeding sheet of paper temporarily in the middle of sheet carrying. In a series of continuous carrying steps, a sheet distance sufficient for switching operation of the gate 23 can be obtained naturally.

As described above, according to the present invention, it is possible to provide an image forming unit system in which a sheet handling unit having a fixed sheet carrying-in rate is connected to an image forming unit having a sheet ejection rate controlled variably so that stable sheet carrying can be achieved.

What is claimed is:

1. An image forming unit system including a sheet handling unit connected to a post stage of an image forming unit, wherein a sheet carrying rate of a sheet carrying-in roller pair provided in said sheet handling unit is defined to be higher than a sheet carrying rate of a sheet ejection roller pair provided in said image forming unit, and a pressing force of said sheet carrying-in roller pair is defined to be smaller than a pressing force of said sheet ejection roller pair.

2. An image forming unit system according to claim 1, wherein said sheet ejection roller pair is provided so that the sheet carrying rate thereof can be switched between a first carrying rate in the case where a sheet of paper is ejected in a face-up ejection mode, and a second carrying rate defined to be higher than said first carrying rate in the case where a sheet of paper is ejected in a face-down ejection mode.

3. An image forming unit system according to claim 1 or 2, wherein said sheet handling unit includes a gate member for switching a destination of sheet ejection, and in that sheet carrying rates and pressing forces of said sheet ejection roller pair and said sheet carrying-in roller pair values so that a distance is provided between preceding and succeeding ones of sheets of paper which are being carried so as to be sufficient to obtain a time equivalent to a time required for switching of said gate member.

* * * * *